US007029305B2

(12) United States Patent
Weidner

(10) Patent No.: US 7,029,305 B2
(45) Date of Patent: Apr. 18, 2006

(54) COAXIAL CONNECTOR WITH TORQUE LIMITING CONTROL

(75) Inventor: Kevin Edward Weidner, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/654,320

(22) Filed: Sep. 3, 2003

(65) Prior Publication Data

US 2005/0037664 A1 Feb. 17, 2005

(51) Int. Cl.
*H01R 13/62* (2006.01)

(52) U.S. Cl. ..... 439/322

(58) Field of Classification Search ..... 439/63, 439/322, 320, 323, 474; 411/1–7
See application file for complete search history.

(56) References Cited

U.S. PATENT DOCUMENTS

| | | | | |
|---|---|---|---|---|
| 4,046,052 | A * | 9/1977 | Nordstrom | 411/1 |
| 4,718,854 | A * | 1/1988 | Capp et al. | 439/63 |
| 4,795,352 | A * | 1/1989 | Capp et al. | 439/63 |
| 5,041,004 | A | 8/1991 | Waldorf | 439/306 |
| 6,086,282 | A * | 7/2000 | Dutt et al. | 403/41 |

* cited by examiner

*Primary Examiner*—Phuong Dinh

(57) ABSTRACT

An electrical connector is provided that includes a base portion configured for stationary mounting to a circuit board and an interface portion configured for mating to a plug assembly. The interface portion is configured for rotational movement relative to the base portion when a predetermined torque is applied to the interface portion.

25 Claims, 2 Drawing Sheets

COAXIAL CONNECTOR WITH TORQUE LIMITING CONTROL

BACKGROUND OF THE INVENTION

The invention relates generally to electrical connectors and, more particularly, to coaxial connector jacks for mounting to a circuit board.

Due to their favorable electrical characteristics, coaxial cables and connectors have grown in popularity for interconnecting electronic devices and peripheral systems. Typically, coaxial connector jacks are mounted to a circuit board of an electronic device at an input/output port of the device and extend through an exterior housing of the device for connection with a mating connector, typically in the form of a cable and plug assembly. The jacks include an inner or signal conductor coaxially disposed within an outer conductor, with a dielectric material separating the signal and outer conductors.

Conventional coaxial connector jacks tend to be one of two basic types. In the first type, the jack is threaded to mate with a compatibly threaded connector. The second is the bayonet coupling style coaxial connector jacks that include a laterally facing pin or lug on the jack that is captured within a slot on the mating connector as the mating connector is rotated. Both of these basic coaxial connector configurations require that the connector be mated to the jack by rotating the connector relative to the jack to engage the connector to the jack.

It is desirable that the connector-to-circuit board connections of the jacks be as durable as possible to withstand repeated mating and unmating of the connectors. However, these connector-to-circuit board connections are sometimes broken by the application of too much torque when a mating connector is being attached to the jack. This risk of damage to the connector jack is increased in those situations where tools are used to mate the connectors. It would therefore be desirable to provide a coaxial connector that is less susceptible to damage due to over-torquing during engagement with a mating connector.

BRIEF DESCRIPTION OF THE INVENTION

In an exemplary embodiment of the invention, an electrical connector is provided that includes a base portion configured for stationary mounting to a circuit board and an interface portion configured for mating to a plug assembly. The interface portion is configured for rotational movement relative to the base portion when a predetermined torque is applied to the interface portion.

Optionally, a torque limiting member is positioned between the base portion and the interface portion, and is configured to limit the torque transferred from the interface portion to the base portion. A flange projects from the interface portion and a collar is coupled to one of the base portion and the interface portion.

In another exemplary embodiment, the electrical connector includes a base portion configured for stationary mounting to a circuit board, an interface portion configured for mating to a plug assembly, and a torque limiting member engaging the base portion and the interface portion to limit the torque transmitted to the base portion from the interface portion.

In yet another exemplary embodiment, a coaxial connector is provided that includes a housing having an upper mating end, a lower end, and a contact cavity extending therebetween, and a base portion configured for stationary mounting to a circuit board. The base portion is configured to receive the mating end of the housing. A torque limiting member engages the base portion and the housing to limit the torque transmitted to the base portion from the housing. A collar is coupled to one of the base portion and the housing. The collar urges the torque limiting member, the base portion, and the housing in contact with one another. The housing is rotatable with respect to the base portion when a predetermined torque is applied to the housing.

DETAILED DESCRIPTION OF THE INVENTION

Figure 1:
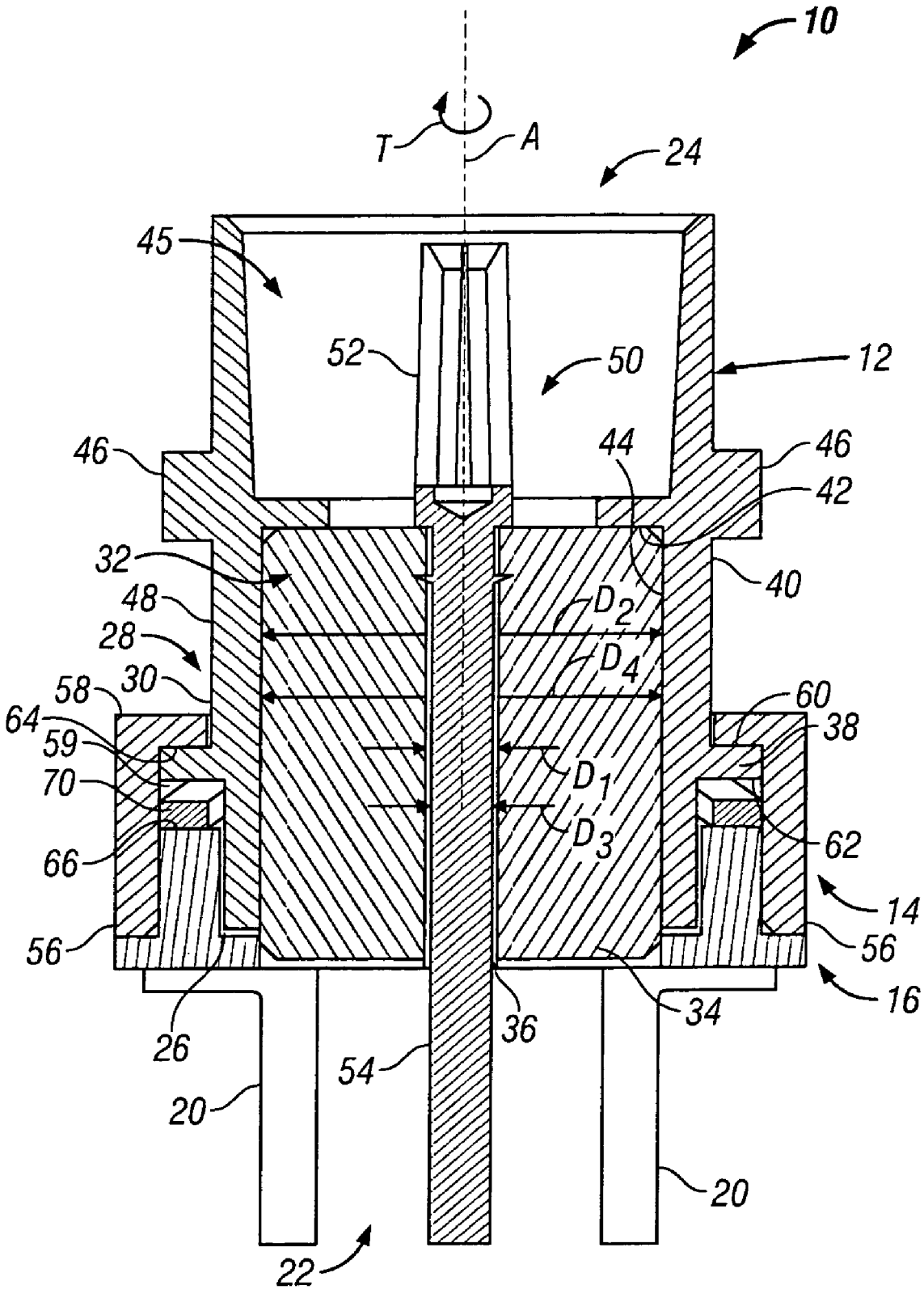
FIG. 1 is a cross-sectional view of a coaxial connector jack formed in accordance with an exemplary embodiment of the present invention.

FIG. 1 is a cross-sectional of a coaxial connector jack 10 formed in accordance with an exemplary embodiment of the present invention. The connector jack 10 includes an interface portion 12, a collar 14, and a base portion 16. The connector jack 10 is mounted to a circuit board (not shown) via one or more mounting posts 20, two of which are shown in FIG. 1. The mounting posts 20 extend into the circuit board to make contact with an electrical circuit thereon.

The base portion 16 is electrically and mechanically coupled to the mounting posts 20 according to known techniques, such as, for example, by soldering. The base portion 16 may also be integrally formed with mounting posts 20. In an alternative embodiment, the base portion 16 is surface mounted to a circuit board in lieu of through hole mounting with the posts 20.

The interface portion 12 includes a lower end 22 and an upper mating end 24. The base portion 16 includes an opening 26 sized to receive the lower end 22 of the interface portion 12. The interface portion 12 is rotatable within the opening 26. The interface portion 12 includes a housing 28 that has a body 30 having a cavity 32 therein. The cavity 32 is filled with a dielectric 34. The dielectric 34 includes a centrally located signal contact cavity 36 longitudinally extending from the lower end 22 to the mating end 24 of the interface portion 12. The housing body 30 includes a flange 38 proximate the lower end 22. The flange 38 extends laterally from the housing body 30. In one embodiment, the flange 38 extends around a perimeter 40 of the housing body 30. Alternatively, the flange 38 may be formed as a series of separate and non-continuous flanges around the perimeter 40 of body 30. The housing body 30 may be cylindrical in shape, although any geometry may be used within the spirit of the invention.

The housing body 30 includes a shoulder 42 on an internal surface 44, proximate the mating end 24. The shoulder 42 retains the dielectric 34. The housing body 30 also includes a plug receiving cavity 45 at the mating end 24 to receive a plug connector (see FIG. 2.). Mating lugs 46 are provided on an exterior surface 48 of the mating end 24 of the housing body 30 for coupling a plug connector to the connector jack 10.

Figure 2:
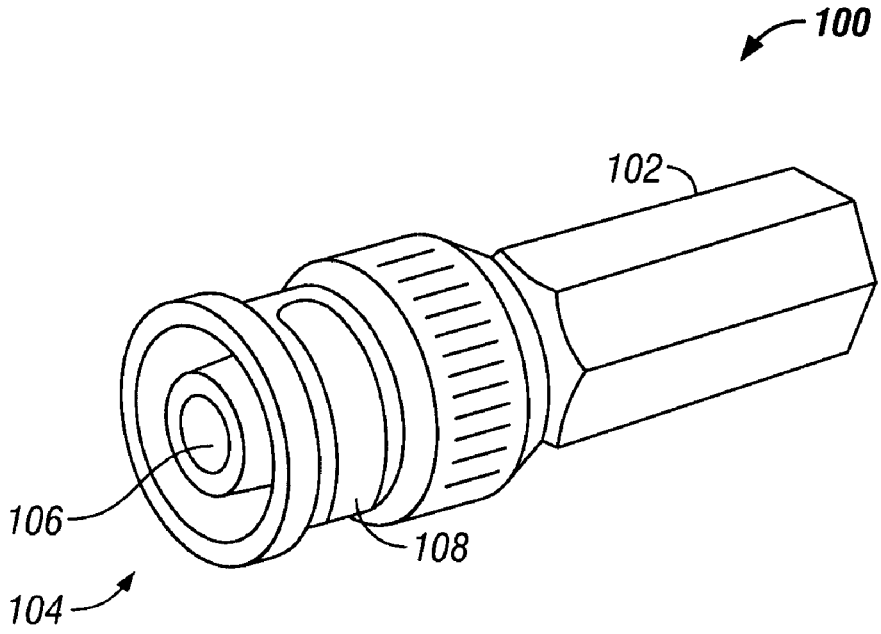
FIG. 2 is a perspective view of a plug connector that may be used with the connector jack of FIG. 1.

FIG. 2 illustrates a perspective view of a plug connector 100 that may be used with the connector jack 10. The plug connector 100 includes a body 102, and a mating end 104 that includes a contact opening 106. The plug connector 100 also includes a pair of lug slots 108 that each partially extend around the mating end 104. The lug slots 108 receive the mating lugs 46 (see FIG. 1) on the interface portion 12 of the connector jack 10 to mate the plug connector 100 to the connector jack 10. When mating the plug connector 100, a torque T is applied about an axis A to the interface portion 12 which, if not controlled, may damage the connection of the base portion 16 to the mounting posts 20 on the circuit board.

With reference to FIG. 1, a signal contact 50 extends through the signal contact cavity 36 culminating in a terminal contact 52 positioned within the plug receiving cavity 45. The signal contact 50 includes a lead 54 that passes through the signal contact cavity 36. The signal contact cavity 36 has a diameter $D_1$ which is slightly larger than an outer diameter $D_3$ of the lead 54 such that the lead 54 is not tightly encapsulated within the signal contact cavity 36. In this manner, the housing 28 along with the dielectric 34 are rotatable with respect to the lead 54.

The dielectric 34 has an outer diameter $D_2$ and the housing body 30 has a diameter $D_4$ of internal surface 44. The connector jack 10 has a characteristic impedance at a given cross section that is controlled by the interaction between the diameter $D_1$ of the contact cavity 36, the diameter $D_2$ of the dielectric 34, the diameter $D_3$ of the lead 54, and the inner diameter $D_4$ of the housing body 30, in conjunction with a dielectric constant of the dielectric material.

The collar 14 interconnects the base portion 16 with the interface portion 12. The collar 14 includes a first end 56 coupled to base portion 16 and a second end 58 engaging the housing body 30. The collar 14 is coupled to the base portion 16 and is formed to retain the flange 38 in a space 59 between the base portion 16 and the collar 14. In one embodiment, the collar 14 is coupled to the base portion 16 with a press fit engagement. However, other methods such as, for instance, threaded fasteners, clamps, and the like that preserve electrical connectivity between the collar 14 and the base portion 16 are also contemplated.

The flange 38 includes an upper surface 60 and a lower surface 62. A torque limiting member 70 is positioned between the flange 38 and the base portion 16 to engage flange surface 62 and a surface 66 of the base portion 16. Alternatively, it is also contemplated that the torque limiting member 70 may be positioned between the flange upper surface 60 and collar surface 64. The torque limiting member 70 is also a biasing element that maintains the housing body 30 in contact with the base portion 16 to maintain electrical connectivity between the housing body 30 and the base portion 16. The torque limiting member 70 is also a friction element that is positioned between the collar 14 and the base portion 16 and in contact with the flange 38 so that relative motion between the interface portion 12 and the base portion 16 is resisted. When a plug connector is mated to the connector jack 10, the interface portion 12 is subjected to a torque T about the axis A. When a predetermined amount of torque is applied to the interface portion 12, the torque limiting member 70 allows slippage between the torque limiting member 70, the flange 38, and the base portion 16 so that interface portion 12 is rotatable with respect to the base portion 16. In this manner, damage to the connector jack 10 from the application of excessive torque applied to the interface portion 12 is avoided.

Figure 3:
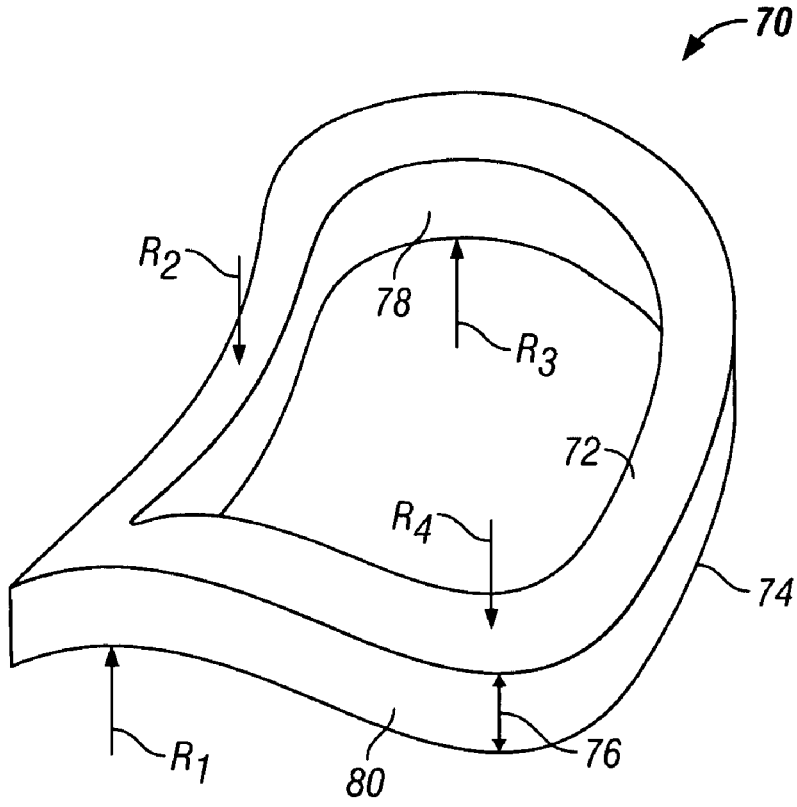
FIG. 3 is a perspective view of an exemplary torque limiting member used with the connector jack of FIG. 1.

FIG. 3 is a perspective view illustrating the torque limiting member 70 in greater detail. The torque limiting member 70 includes an upper surface 72 and a lower surface 74 that define a thickness 76 therebetween. The torque limiting member 70 also includes bend radii $R_1$, $R_2$, $R_3$, and $R_4$ that impart a wave effect including elevated and depressed areas in each of the upper and lower surfaces 72 and 74 respectively. The torque limiting member includes both vertical and horizontal bends that impart alternating concave and convex sections along the upper and lower surfaces 72 and 74 and also along an inner side edge 78 and an outer side edge 80. The torque limiting member 70 is a compressible member such that, when compressed or flattened, the torque limiting member 70 acts as a biasing member biasing the flange 38 toward the collar 14.

In the embodiment shown in FIG. 1, the torque limiting member 70 biases the flange 38 toward the collar 14 such that electrical connectivity is maintained between the housing body 30 and the base portion 16 via the flange 38 and the collar 14. Alternatively, the torque limiting member 70 may be positioned between the flange upper surface 60 and the collar surface 64 such that the flange 38 is biased directly against the base portion 16 maintaining electrical connectivity between the base portion 16 and the housing body 30.

The torque limiting member 70 is also a friction member that, when compressed, resists relative rotational motion between the base portion 16 and the interface portion 12 as torque is applied to the interface portion 12 while a connector plug 100 (FIG. 2) is being mated to the mating end 24 of the interface portion 12. The torque limiting member 70 is designed such that at a predetermined torque limit, slippage occurs between the torque limiting member 70 and the flange 38 allowing the interface portion 12 to then rotate with respect to the base portion 16 so that the connector jack 10 is not damaged as a result of the application of excessive torque to the interface portion 12 being transmitted to the base portion 16.

The Torque limiting member 70 is designed to provide a specified torque resistance limit and axial load for a given connector jack such as connector jack 10. The torque limit and axial load generating characteristics of the torque limiting member 70 are determined by the material composition, thickness, number of bends, and the bend radii. Dimensionally, the torque limiting member 70 is sized to compliment the particular connector jack with which it will be used. Although illustrated in FIG. 3 as resembling a script letter D, it is to be understood that the torque limiting member 70 may take any geometric shape that is compatible with the particular connector jack with which it will be used.

In an exemplary embodiment, the torque limiting member 70 is made of a metal having at least some degree of spring type resilience such that when formed, the material is capable of generating a resistance to being compressed. Alternatively, the torque limiting member 70 may be fabricated from other material such as, for instance, a resilient plastic or composite material commonly used for such purposes and as are well known by those of ordinary skill in the art.

In use, the connector jack 10 is assembled by positioning the torque limiting member 70 adjacent the flange 38 and coupling the collar 14 to the base portion 16 so that the flange 38 and the torque limiting member are retained in the space 59 between the base portion 16 and the collar 14. The base portion 16 and the collar 14 are dimensionally sized such that the torque limiting member 70 is compressed when the base portion 16 and the collar 14 are joined. The connector jack 10 is then mounted on a circuit board by joining the base portion 16 to the mounting posts 20 using any suitable method commonly known in the art. Optionally, in a surface mount application, the base portion 16 is soldered to a surface connection on the circuit board. The torque limiting member 70, by being compressed, generates a frictional force that resists relative motion between the interface portion 12 and the base portion 16 to allow a plug connector to be mated to the connector jack 10. However, if the specified torque limit is reached, the frictional force resisting relative motion between the base portion 16 and the interface portion 12 is overcome and slippage occurs so that damage to the connector jack 10, and more specifically, to the connection between the mounting posts 20 and the base portion 16, does not occur. Being under compression, the torque limiting member 70 also generates an axial load that maintains ground circuit connectivity between the base portion 16 and the interface portion 12.

The embodiments thus described provide a coaxial connector jack with torque limiting control. The connector jack can be mounted on a circuit board and when a plug is mated to the connector, the torque transmitted from the interface portion of the connector to the connector base so that damage to the base connection to the circuit board from over-torquing of the plug is avoided. The torque limiting member also provides an axial load that facilitates the maintenance of electrical connectivity in the ground circuit from the base portion to the interface portion of the connector.

While the invention has been described in terms of various specific embodiments, those skilled in the art will recognize that the invention can be practiced with modification within the spirit and scope of the claims.

What is claimed is:

1. An electrical connector comprising:

a base portion configured for stationary mounting to a circuit board; and an interface portion having at least one lug configured to be driven by a rotatable part of a mating connector, said interface portion received within said base portion and connected for rotational movement relative to said base portion when a predetermined torque is applied to said interface portion by said rotatable part driving said at least one lug.

2. The electrical connector of claim 1 further comprising a torque limiting member between said base portion and said interface portion, said torque limiting member configured to limit the torque transferred from said interface portion to said base portion.

3. The electrical connector of claim 1 further comprising a torque limiting member between said base portion and said interface portion, said torque limiting member including a friction element configured to limit the torque transferred from said interface portion to said base portion through said friction member.

4. The electrical connector of claim 1 wherein said base portion comprises at least one mounting post for mounting said base portion to the circuit board.

5. The electrical connector of claim 1 wherein said base portion is configured for surface mounting to the circuit board.

6. The electrical connector of claim 1 further comprising a flange projecting from said interface portion.

7. The electrical connector of claim 1 further comprising a collar coupled to one of said base portion and said interface portion.

8. The electrical connector of claim 7 further comprising a torque limiting member between said base portion and said interface portion, said torque limiting member configured to bias said interface portion against said collar to maintain an electrical connection therebetween.

9. The electrical connector of claim 1 wherein said interface portion includes a longitudinally extending cavity therethrough and a signal contact within said cavity, said interface portion being rotatable with respect to said signal contact.

10. The electrical connector of claim 1 wherein said interface portion includes an interior region having a dielectric therein, said dielectric defining a longitudinally extending cavity therethrough, said cavity having a first diameter, said dielectric having a second diameter different from said first diameter, and said dielectric having a dielectric constant, said first and second diameters and said dielectric constant determining a characteristic impedance for said connector.

11. The electrical connector of claim 1 wherein said base portion and said interface portion comprise a coaxial connector.

12. An electrical connector comprising:

a base portion configured for stationary mounting to a circuit board;

an interface portion having at least one lug configured to be driven by a rotatable part of a mating connector, said interface portion received within said base portion and connected for rotation relative to said base portion when torque is applied to said interface portion by said rotatable part driving said at least one lug; and a torque limiting member engaging said base portion and said interface portion and arranged to limit the torque transmitted to said base portion from said interface portion.

13. The electrical connector of claim 12 wherein said torque limiting member comprises a friction element configured to limit the torque transferred from said interface portion to said base portion through said friction member.

14. The electrical connector of claim 12 wherein said base portion comprises at least one mounting post for mounting said base portion to the circuit board.

15. The electrical connector of claim 12 further comprising a flange projecting from said interface portion.

16. The electrical connector of claim 12 further comprising a collar coupled to one of said base portion and said interface portion.

17. The electrical connector of claim 16 wherein said torque limiting member is configured to bias said interface portion against said collar to maintain an electrical connection therebetween.

18. The electrical connector of claim 12 wherein said interface portion includes a longitudinally extending cavity therethrough and a signal contact within said cavity, said interface portion being rotatable with respect to said signal contact.

19. The electrical connector of claim 12 wherein said base portion and said interface portion comprise a coaxial connector.

20. A coaxial connector comprising:

a housing having an upper mating end, a lower end, and a contact cavity extending therebetween;

a base portion configured for stationary mounting to a circuit board, said base portion configured to receive said mating end of said housing;

a torque limiting member engaging said base portion and said housing to limit the torque transmitted to said base portion from said housing;

a collar coupled to one of said base portion and said housing, said collar urging said torque limiting member, said base portion, and said housing in contact with one another; and wherein said housing is rotatable with respect to said base portion when a predetermined torque is applied to said housing.

21. The connector of claim 20 wherein said housing includes a circumferential flange configured for engagement with said torque limiting member.

22. The connector of claim 20 wherein said housing is rotatable with respect to a contact within said contact cavity.

23. The connector of claim 20 wherein said torque limiting member is configured to bias said housing against said collar to maintain an electrical connection therebetween.

24. The connector of claim 20 wherein said torque limiting member comprises a friction element.

25. The connector of claim 20 wherein said contact cavity extends through a dielectric within an interior of said housing, said contact cavity having a first diameter, said dielectric having a second diameter at an outer periphery thereof, said contact having a third diameter at an outer periphery thereof, said housing having a fourth diameter at an inner surface thereof, and said dielectric having a dielectric constant, said first, second, third, and fourth diameters and said dielectric constant detennining a characteristic impedance for said connector.

* * * * *